US007012195B2

(12) United States Patent
Zettel et al.

(10) Patent No.: US 7,012,195 B2
(45) Date of Patent: Mar. 14, 2006

(54) WIRE MESH SEAL ELEMENT WITH SOFT FLAT AND HARD ROUND WIRES

(75) Inventors: Steven A. Zettel, Cranston, RI (US); Zlatomir Kircanski, Cumberland, RI (US)

(73) Assignee: ACS Industries, Inc., Woonsocket, RI (US)

( * ) Notice: Subject to any disclaimer, the term of this patent is extended or adjusted under 35 U.S.C. 154(b) by 0 days.

(21) Appl. No.: 10/616,768

(22) Filed: Jul. 10, 2003

(65) Prior Publication Data

US 2005/0006134 A1 Jan. 13, 2005

(51) Int. Cl.
*H01B 7/08* (2006.01)

(52) U.S. Cl. ..... 174/117 M

(58) Field of Classification Search ..... 174/117 M, 174/106 R, 109, 110 A; 138/123, 124, 127
See application file for complete search history.

(56) References Cited

U.S. PATENT DOCUMENTS

| | | | | |
|---|---|---|---|---|
| 2,438,146 | A * | 3/1948 | Candee et al. | 174/68.3 |
| 4,278,717 | A | 7/1981 | Aoyama | |
| 4,345,624 | A * | 8/1982 | Rider | 138/110 |
| 4,607,851 | A * | 8/1986 | Usher | 264/258 |
| 4,817,613 | A * | 4/1989 | Jaraczewski et al. | 600/435 |
| 5,091,609 | A * | 2/1992 | Sawada et al. | 174/110 A |
| 5,569,220 | A * | 10/1996 | Webster, Jr. | 604/527 |
| 5,617,900 | A * | 4/1997 | Weil | 138/127 |

* cited by examiner

*Primary Examiner*—Chau N. Nguyen
(74) *Attorney, Agent, or Firm*—Bradley N. Ruben

(57) ABSTRACT

A wire mesh element having soft wire on the outside and precipitation-hardened wire on the inside is used a bushing, seal, seat, or support, and is useful as an end seal for a catalytic converter. The soft wire on the outside can be flat to aid it shielding the internal wire from corrosion due to impingement hot exhaust gasses.

14 Claims, 5 Drawing Sheets

WIRE MESH SEAL ELEMENT WITH SOFT FLAT AND HARD ROUND WIRES

BACKGROUND OF THE INVENTION

1. Field of the Invention

This invention relates to wire mesh support elements especially for high temperature environments, and methods for making the same.

2. The State of the Art

Devices made from knitted wire mesh are commonly used as seals, bushings, seats, and supports in exhaust systems for internal combustion engines. Such devices are used in connecting exhaust system conduits, supporting the periphery of the catalytic converter in its housing, and supporting the axial ends of the catalytic converter in its housing, among other functions.

In these types of devices, a wire is knitted into a mesh, and the mesh is compacted in a die into a particular shape. Sometimes the compaction is partial, and the partially-compacted structure can be infiltrated with a high temperature resistant material, such as described in U.S. Pat. No. 5,385,873 (the disclosure of which is incorporated herein by reference). Other times the compaction results in a denser article that can be used as a bushing at the end of a catalytic converter, such as described in U.S. Pat. Nos. 4,683,010 and 6,286,840 (the disclosures of which are incorporated herein by reference). Still other devices are even more densely compacted and can be used as a filter in an air bag assembly, as described in U.S. Pat. No. 6,277,166 (the disclosure of which is incorporated herein by reference).

In the area of bushings, seals, and supports used in combination with catalytic converters, there are two basic uses for such devices, whether or not made of wire mesh.

One type of support device spans the perimeter of the catalytic converter substrate or support, which is usually round or oval in shape, and this device supports the substrate in its metal housing, giving the housing its characteristic round or oval shape when seen from the underside of the car, although the substrate and its housing can be in any geometry. A conventional substrate is a ceramic monolith. In this environment, the device must cushion the monolith from bumps and jolts in a radial direction (with respect to the direction of the gas flow through the ceramic monolith).

The other type of support device is used at the ends of the substrate, where the exhaust gases enter the pores of the monolith for catalytic conversion, and where the catalytic reaction products exit. In this environment, the support device must cushion the monolith from bumps and jolts in the axial direction (again with respect to the direction of the gas flow) and should direct the hot inflowing gas stream away from the perimeter of the monolith to avoid damaging the perimeter support device and bypassing the conversion process. These end location support devices can be thought of as also providing a sealing or baffling function because they deflect the hot exhaust gases from impinging on the perimeter support device and seal the gas conduit so the exhaust gases enter the catalytic converter as intended. The perimeter cushioning device may be an intumescent mat. The hot exhaust gas can erode the edge of the mat, thereby compromising its cushioning ability and eventually causing the mat to fail. Some prior art end-located support devices were comprised of a compacted element with round wire on the outside and flat wire on the inside.

Problems with wire mesh support devices used in exhaust systems are typically thermal expansion effects and corrosion effects, especially in the environment of the catalytic converter. The cold working (drawing, molding) of wire can cause hardening of the wire, which thereby affects the compression characteristics of the wire mesh element. The thermal expansion of hardened wire that does not soften upon heating can crack the ceramic monolith. On the other hand, wire that softens upon heat requires accounting for different compression characteristics at different temperatures. Yet other problems involve corrosion: wire that maintains its compression characteristics is typically not as corrosion resistant as wire that softens upon heat, which is typically more corrosion resistant.

SUMMARY OF THE INVENTION

In light of the foregoing, this invention provides a wire mesh element especially for use in the exhaust system of an internal combustion engine, but generally suitable for providing mechanical support and some sealing benefits in any hot and/or corrosive gas environment.

One object of this invention is to provide such an element having improved compression characteristics.

Another object of this invention is to provide such an element while avoiding the problems of thermal expansion that can crack the catalyst support.

Yet another object of this invention is to provide such an element that cushions against axial and/or radial movement, and preferably having tailored axial and radial compression characteristics.

Still another object of this invention is to provide such an element that will not deteriorate or lose its ability to protect the substrate (e.g., the monolith) after being subjected to the high temperature environment, and through the cooling cycles between ambient and the high temperature environments that occur with daily use of the engine.

Yet another object of this invention is to provide such an element with improved properties for preventing the hot gas from flowing through the element.

In summary, this invention provides a wire mesh element having a combination of hard and soft wire meshes, and the outer surface having the softer wire. In a preferred embodiment, the soft wire is flat and the hard wire is round.

This invention also provides a method for making such an element by overknitting a hard wire mesh tube onto a soft wire mesh tube, inverting and rolling the tube-within-a-tube structure into a ring, and then compressing the ring into the desired shape. In a preferred embodiment, by predetermining the density of each of the two mesh tubes, and by rolling up from both ends of the interdisposed tube structure, different portions of the element can be made with different compression characteristics.

The wire mesh elements of this invention: does not interfere with present assembly procedures when used as the end element for a catalytic converter; has a compression characteristic that will not damage the ceramic monolith; maintains its compression characteristics after heating and cooling cycles; meets all present engineering requirements for durability; prevents hot exhaust gases from contacting the perimeter support; and provides axial and radial mechanical cushioning.

DETAILED DESCRIPTION OF SPECIFIC EMBODIMENTS

Wire knitting machines are well-known to those in the art. Among those machines are ones that knit a tube (or sock), and those types of machines are used in making the elements of this invention.

In general, when wire is made, it has undergone a number of size reductions at a reduced temperature (i.e., much below its annealing temperature). This "cold working" makes the wire harder, but less ductile. The ductility can be increased by heating or annealing the wire, and the annealing also reduces the hardness of the wire, or "softens" it (so the properties after annealing are more akin to the metal prior to cold working). In prior art articles, because of the aforementioned problem with cracking the ceramic monolith, soft (annealed) wire is used.

In the present invention, a combination of hard and soft wire is used. In addition, it is preferred that the soft wire be flat and the hard wire be round.

The soft wire is comprised of any high temperature resistant metal, preferably stainless steel, such as type 309, preferably type 310 or higher, that can be knit. For a diesel application, type 304 stainless steel wire is suitable. In general, any ferritic, and preferably austenitic, wire is suitable. Preferably the wire is also flattened and so has a greater surface area, acting as a baffle in the element to prevent the exhaust gases from passing through the element; at the end of a catalytic converter, this baffling effect directs the gases into the converter. Various wire diameters can be chosen, depending on the desired compression characteristics and the baffling effect needed. In general, the soft wire diameter (prior to flattening) is 0.001 inch to 0.020 inch. When flattened, the wire is preferably flattened to a thickness of about one-third of the diameter. A suitable wire for a gasoline engine is 310 wire having an initial diameter of 0.006 inch and flattened to a thickness of 0.002 inch. If the mesh is knitted on a multifeed machine, the thickness of the wire on each spool need not be identical; it is sufficient that all of the wire thickness meet the intended specification.

The wire, after flattening if flattened, is knitted into a mesh having a tube configuration in a conventional wire knitting machine. Thereafter, the wire mesh is annealed in an oxide-producing atmosphere. For example, a mesh made from 310 type wire can be annealed at 1000° C. in an oxygen-containing atmosphere for about five minutes. This annealing step softens the wire, provides an oxide coating on its surface (which enhances its resistance to corrosion), and stabilizes the compression characteristics (both axial and radial) of that mesh element.

Figure 1:
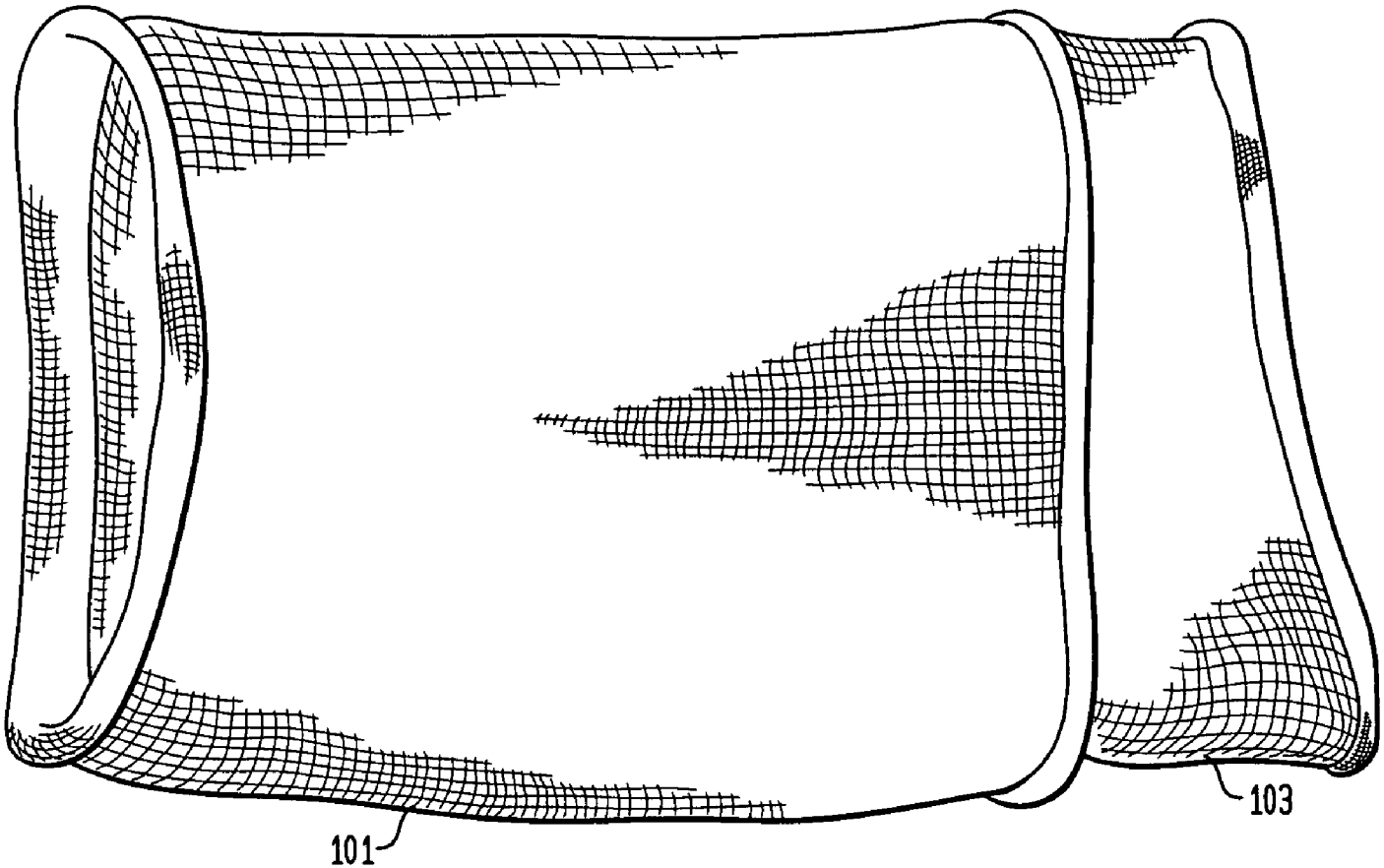
FIG. 1 is a photograph showing a knitted flat wire mesh tube disposed partially within a knitted round wire mesh tube.

The soft wire mesh is then fed into the mouth of a conventional wire knitting machine and a round wire mesh tube is overknit onto the soft wire mesh tube. The round wire is preferably a precipitate-hardened stainless steel, such as type, A286 or higher. This precipitation-hardened wire also hardens at high temperatures, so the springiness of the mesh increases as the temperature increases to the operating temperature the first time; that is, the spring force of the mesh increases with temperature. Once this precipitation-hardened mesh is hardned the first time in operation, it maintains that hardness. In manufacture, it is preferred that the ends of the two tubes beattached (such as by clamping or crimping) and taken up together as the hard wire mesh is knitted over the soft wire to provide interdisposed mesh tubes. As seen in FIG. 1, a hard round wire mesh tube 101 is overknit onto the soft flat wire mesh tube 103.

Figure 2:
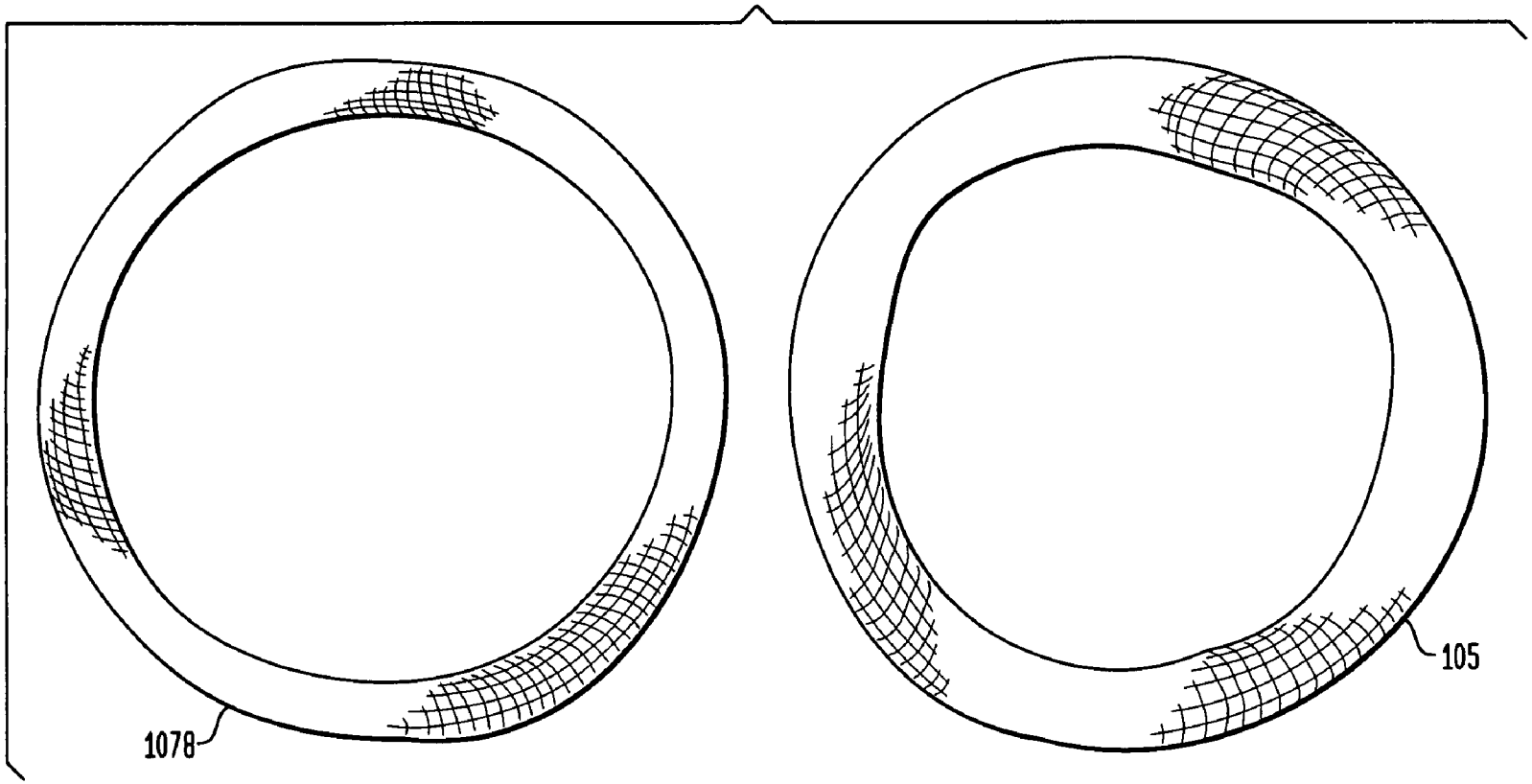
FIG. 2 is a photograph showing the interdisposed tubes of FIG. 1 as rolled up, and as partially flattened.
Figure 3:
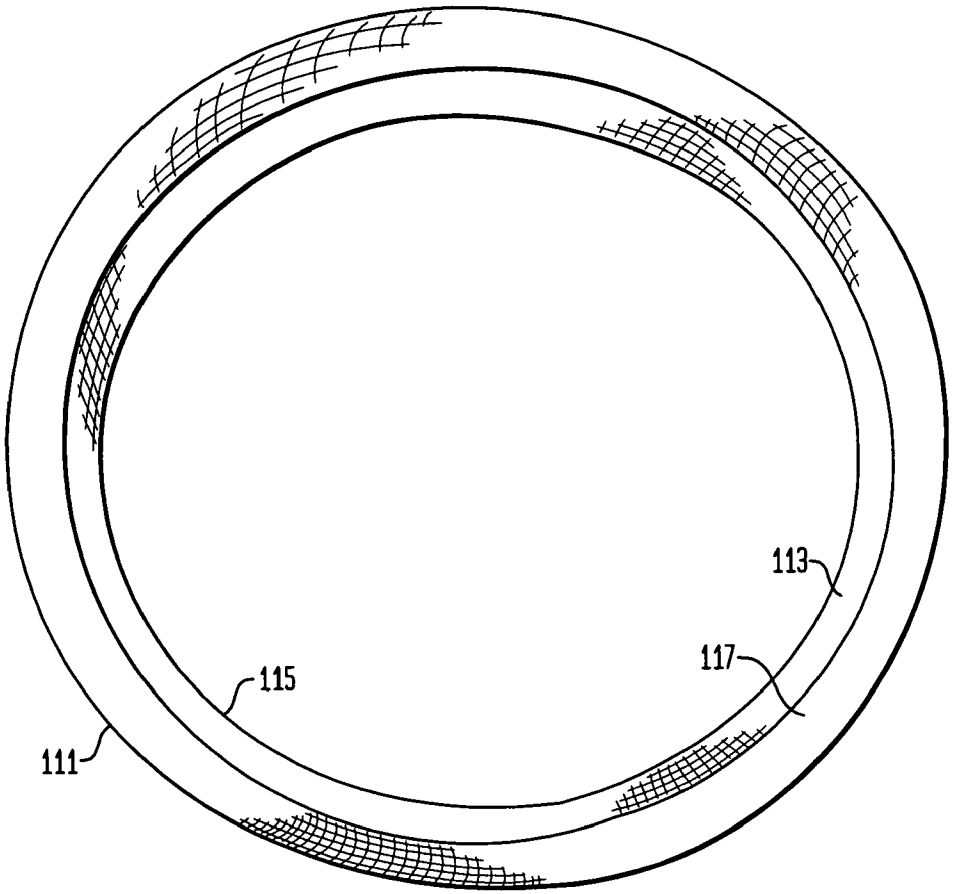
FIG. 3 is a photograph showing the flattened article seen in FIG. 2 after shaping in a die.

After the interdisposed (dual) mesh tubes are taken up, a support device is made as follows. The dual mesh tube is cut to a predetermined weight. The weight is determined after prototype parts of the desired dimensions are made to a desired density, the weight of the part is then determined, and the corresponding length of the dual mesh tube is cut after the weight per length of the dual mesh tube is determined. The dual mesh tube is then rolled up to produce a ring 105 as seen in FIG. 2. When the dual tube is rolled up, essentially turned inside out, the inner soft wire mesh ends up on the outside of the ring. In addition, the amount (weight) of mesh needed for a typical support element requires multiple turns when rolling up, resulting in a multilayer ring. This ring is then flattened to produce a flattened ring 107 as seen in FIG. 2. The flattening is not necessary, but can facilitate placing the ring into a die for molding into the final shape desired. The flattened ring is molded to produce a seal element 111 as seen in FIG. 3, wherein the seal element has a ring wall portion 113 and a flange or lip 115 at one edge of the wall that extends into the central bore 117. The lip provides axial cushioning, and the ring wall provides radial cushioning. Molding is typically performed by using an open female die, placing the flattened ring into the female die, inserting a male tamp into the die, and compressing. Of course, the element can be molded into any desired geometry, such as an elliptical shape (oval or round) or a rectilinear shape (square, rectangular, or any regular or irregular polygon, for example), or a combination (for example, semi-circular, pie wedge-shaped). The die can provide for the element to have little protrusions, as described in the aforementioned U.S. Pat. No. 6,286,840, so that the elements are less likely to stick together when made to stack or nest together. The element for a catalytic converter as described herein is not meant to stack or nest.

In operation, the final seal element includes a combination of soft and hard wires. As a bushing, seating, and/or sealing element in a catalytic converter, the element is exposed to increasing temperature as the catalytic converter comes up to operating temperature. The spring force of the hard wire increases with this increasing temperature, and the wire tends to expand due to thermal expansion. The hard wire mesh is surrounded by the soft wire mesh and tries to expand into it, making the element more rigid (like inflating a tire) and thereby providing better mechanical support properties in this environment. Accordingly, a precipitate work-hardening austenitic material is preferred for the hard wire because it will have improved hardness at higher temperature rather than softening at higher temperatures. The soft wire also expands at the operating temperature, which accommodates the space created by thermal expansion of the metal catalytic converter housing. The configuration with the hard wire inside the soft wire provides a structure where the thermally-induced expansion of the hard wire is checked by the outside soft wire, the expansion of the hard wire making the element more rigid, and the expansion of the soft wire acting to fill space caused by thermal expansion of the containing structure. In addition, the mesh loops mechanically interlock during compression, essentially fixing the size of the element. Accordingly, as the wires element attempt to expand at the higher operating temperatures, the element becomes more rigid, providing better sealing and compression properties, yet does not cause undesired forces on the ceramic monolith. The soft wire on the outside of the element helps to cushion the ceramic substrate from the hard wire inside the element as the hard wire expands. In addition, the type 310 soft wire has better corrosion resistance than the A286 precipitation-hardened wire, and being on the outside of the element helps to protect the internal hard wire from corrosion due to impingement of the exhaust gases.

When the engine is turned off, the compression characteristics stay the same, so that when the engine is restarted after having cooled, off, the substrate experiences the same compression characteristics. In this way, by determining the compression characteristics desired for a particular application, there is almost no need to engineer or accommodate changes to those characteristics due to the heating and cooling cycles from starting and stopping the engine. Another part of these improved characteristics is due to the use of the flat wire on the outside of the element to increase the resistance to gas flow through the element, whereby gases are diverted to the interior bore (117) of the element. The flat wire fills more space per unit weight than the round wire, and being on the outside provides a surface more akin to a solid surface than round wire, but being soft does not provide undue pressure on the ceramic substrate. Accordingly, the flat wire acts to prevent or reduce impingement of the hot gases onto the hard wire, and so should be made of a corrosion resistant metal. Therefore, it is preferred that the element be positioned on the upstream side of the catalytic converter. It may also be used on the downstream side, or another type of support element can be used on the downstream side.

The substrate (support) for the catalyst need not be ceramic monolith; it may be made of any material that is suitable for supporting the catalyst, by whatever means, and has suitable strength, toughness, non-reactivity, and corrosion characteristics to function in the environment of the catalytic converter. Whatever the composition of the support, the outside wire of the element is preferably flat in order to provide a larger surface area in contact with the monolith. By increasing the surface area of contact the frictional force between the element and the monolith is increased, thereby helping to keep the element and the monolith in contact with each other (the element grabs onto the monolith better when flat wire is present).

Figure 4:
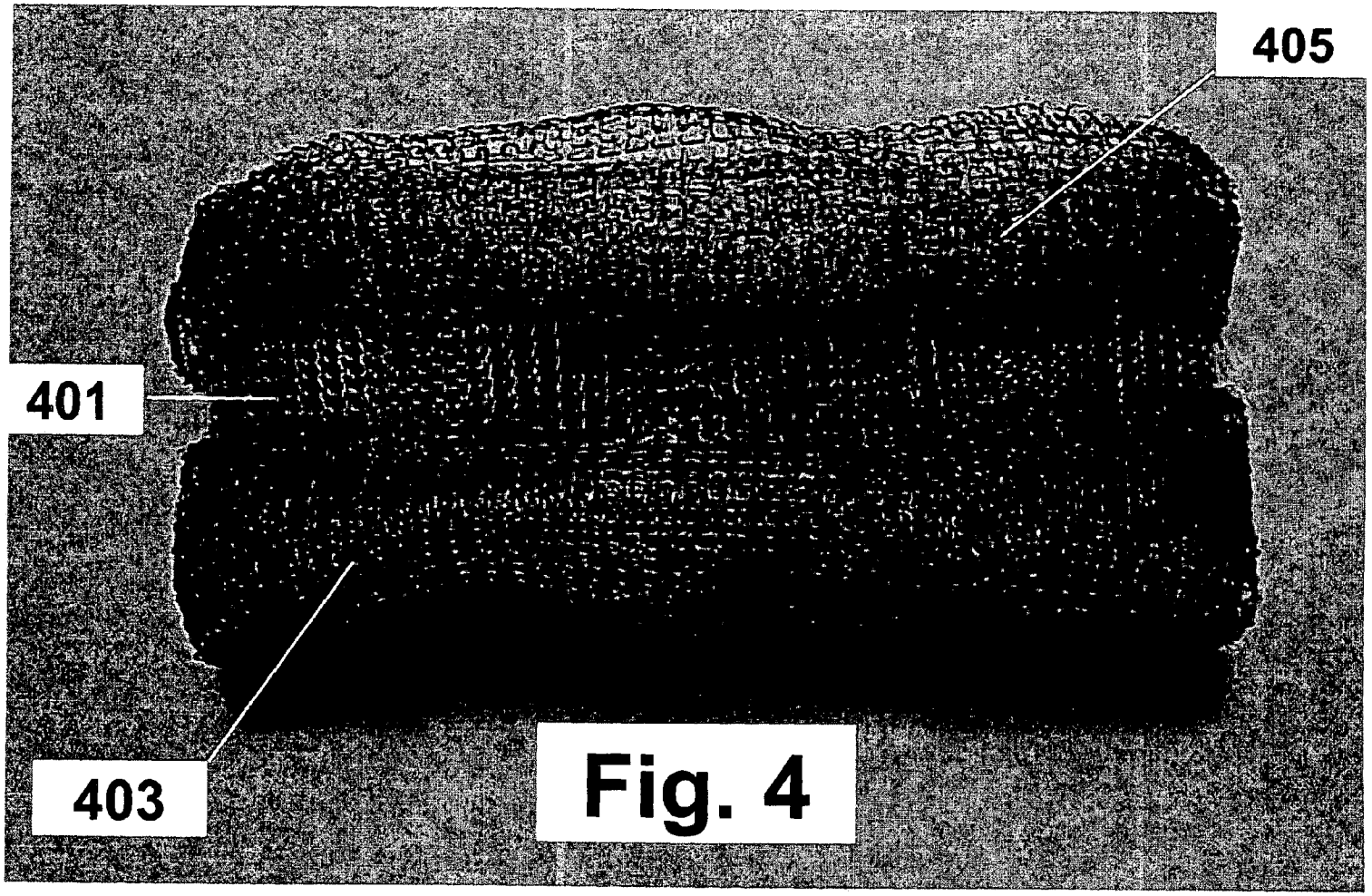
FIG. 4 is a photograph showing the interdisposed tubes as in FIG. 2 having been rolled up from both ends.
Figure 5:
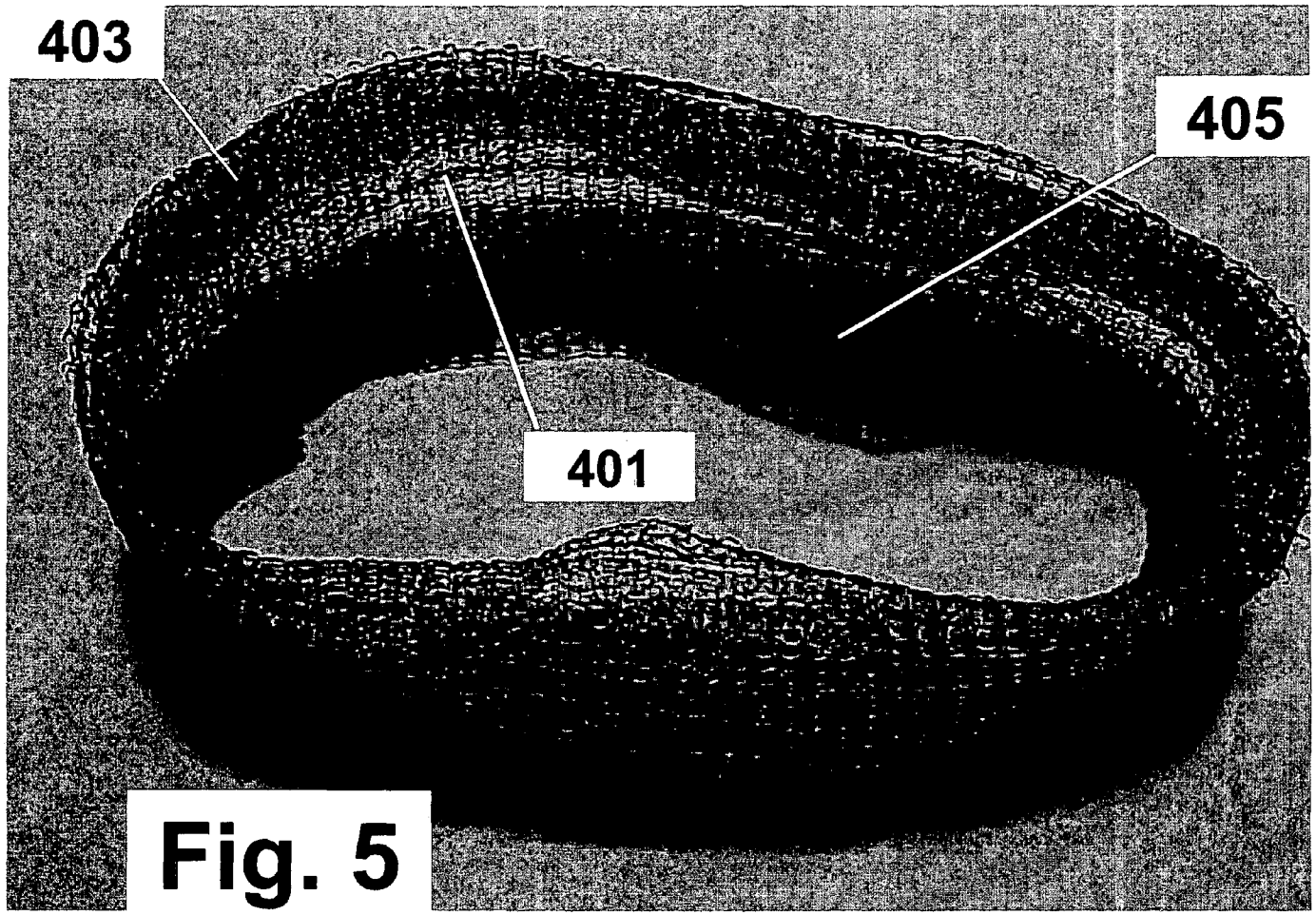
FIG. 5 is a photograph of the rolled-up interdisposed tubes of FIG. 4 having been inverted (turned inside out).

In yet another embodiment, the element can be made so that different areas of the element have different densities, and so the axial and radial compression properties can be varied. The density of a fabric, or wire mesh, is determined by the number of courses per inch (cpi; the number of repeats of the knit pattern per unit length). The density of each of the outside (flat wire) or inside (round wire) meshes can be varied as desired. Because the internal (round) wire is harder, it has a larger effect on the compression characteristics of the element. The compression characteristics of the device can be tailored by varying the cpi of the flat wire to the cpi of the round wire. In addition, the axial and radial compression characteristics can be varied using two separate tori, one for the lip or flange portion and one for the body or ring portion of the element shown in FIG. 3. As shown in FIG. 4, the interdisposed tubes 401 can be rolled up from opposing ends, shown as separate rolls 403 and 405, to provide separate tori. The length (amount) of material provided for each torus will determine its compression characteristics, so the interdisposed tubes can be rolled up by different amounts, providing tori with different amounts of material; and as noted above, the cpi of each mesh can also be varied. Once rolled up as in FIG. 4, the intermediate article is inverted (turned inside out) as shown in FIG. 5, and then molded as described above, where one torus becomes the lip or flange portion and the other torus becomes the body or ring portion.

The foregoing description is meant to be illustrative and not limiting. Various changes, modifications, and additions may become apparent to the skilled artisan upon a perusal of this specification, and such are meant to be within the scope and spirit of the invention as defined by the claims.

What is claimed is:

1. A compressed knitted wire mesh seal element for an exhaust system, consisting essentially of: a combination of an annealed soft flat wire mesh and a hard wire mesh that does not soften at the elevated temperature of a catalytic converter, the soft wire mesh being present on the outer surface of the element, the element being a tube of hard wire knitted mesh within a tube of soft wire knitted mesh, rolled into a ring, and compressed into a combined mesh having an annular geometry.

2. The element of claim 1, wherein the soft wire is at least as heat resistant as type 309 stainless steel.

3. The element of claim 1, wherein the soft wire has an oxide coating on its surface.

4. The element of claim 1, wherein the hard wire is precipitation-hardened.

5. The element of claim 1, wherein the element has a rectilinear geometry, an elliptical geometry, or a combination thereof.

6. The element of claim 5, wherein the ring is has multiple mesh layers.

7. The element of claim 1, wherein the element is in the geometry of an annulus having a flange at an edge thereof.

8. The element of claim 1, wherein the annular mesh seal has a central bore and a flange extending into the central bore.

9. A catalytic converter assembly, comprising: a substrate for a catalytic converter comprising a ceramic monolith disposed in a housing and a first compressed wire mesh element disposed on the upstream side of the converter; said wire mesh seal element consisting essentially of a combination of an annealed soft flat wire mesh and a hard wire mesh that does not soften at the elevated temperature of a catalytic converter, the soft wire mesh being present on the outer surface of the element, and the element being a tube of hard wire knitted mesh within a tube of soft wire knitted mesh, rolled into a ring, and compressed into a combined mesh having an annular geometry.

10. The assembly of claim 9, wherein the monolith is elliptical, rectilinear, or a combination thereof in cross-section, and further comprising a second compressed wire mesh seal element disposed on the downstream side of the monolith consisting essentially of aycombination of an annealed soft flat wire mesh and a hard wire mesh that does not soften at the elevated temperature of a catalytic converter, the soft wire mesh being present on the outer surface of the element, and the element being a tube of hard wire knitted mesh within a tube of soft wire knitted mesh, rolled, and compressed into a combined mesh having an annular geometry.

11. The assembly of claim 10, wherein the hard wire is precipitation-hardened stainless steel.

12. The assembly of claim 10, wherein the annular mesh seal on the downstream side has a central bore and a flange extending into the central bore.

13. The assembly of claim 9, wherein the hard wire is precipitation-hardened stainless steel.

14. The assembly of claim 9, wherein the annular mesh seal on the upstream side has a central bore and a flange extending into the central bore.

* * * * *

UNITED STATES PATENT AND TRADEMARK OFFICE

CERTIFICATE OF CORRECTION

PATENT NO. : 7,012,195 B2
DATED : March 14, 2006
INVENTOR(S) : S. Zettel and Z. Kircanski It is certified that error appears in the above-identified patent and that said Letters Patent is hereby corrected as shown below:

Column 7,
Line 20, change "aycombination" to -- a combination --.

Signed and Sealed this

Twenty-third Day of May, 2006

JON W. DUDAS
*Director of the United States Patent and Trademark Office*